US008613628B2

(12) United States Patent
Kato

(10) Patent No.: US 8,613,628 B2
(45) Date of Patent: Dec. 24, 2013

(54) CARD EDGE CONNECTOR

(75) Inventor: Rintaro Kato, Tokyo (JP)

(73) Assignee: Japan Aviation Electronics, Ltd., Tokyo (JP)

( * ) Notice: Subject to any disclaimer, the term of this patent is extended or adjusted under 35 U.S.C. 154(b) by 6 days.

(21) Appl. No.: 13/540,896

(22) Filed: Jul. 3, 2012

(65) Prior Publication Data

US 2013/0078862 A1 Mar. 28, 2013

(30) Foreign Application Priority Data

Sep. 28, 2011 (JP) ..... 2011-212597

(51) Int. Cl.
*H01R 13/62* (2006.01)

(52) U.S. Cl.
USPC ..... 439/327

(58) Field of Classification Search
USPC ..... 439/325–329
See application file for complete search history.

(56) References Cited

U.S. PATENT DOCUMENTS

| | | | | |
|---|---|---|---|---|
| 6,634,899 | B2 * | 10/2003 | Takahiro et al. | 439/328 |
| 6,743,028 | B2 * | 6/2004 | Wang | 439/92 |
| 7,074,067 | B2 * | 7/2006 | Yang et al. | 439/326 |
| 7,789,692 | B2 * | 9/2010 | Lee | 439/327 |

FOREIGN PATENT DOCUMENTS

CN 201327888 Y 10/2009

* cited by examiner

*Primary Examiner* — Khiem Nguyen
(74) *Attorney, Agent, or Firm* — Maier & Maier PLLC

(57) ABSTRACT

A card edge connector includes an elongated housing; upper and lower stage contacts and held by the housing; and arm members for pressing, toward a connector mounting surface, a memory module to be displaced in a direction away from the connector mounting surface. Inserting an arm inserted portion of each arm member in an insertion groove of the housing allows the housing to hold each arm member freely swingable about the arm inserted portion with respect to the housing. Hemispherical projections for securing at least a predetermined amount of gap amounts of swing gaps are provided in the swing gaps and formed in the longitudinal direction of the housing between the arm member within the insertion groove and the housing.

10 Claims, 12 Drawing Sheets

CARD EDGE CONNECTOR

RELATED APPLICATIONS

This application claims priority under 35 U.S.C. §119 to Japanese Patent Application No. 2011-212597, filed Sep. 28, 2011, the disclosure of which is incorporated by reference herein its entirety.

BACKGROUND OF THE INVENTION

1. Field of the Invention

The present invention relates to a card edge connector.

2. Description of Related Art

As a technique of this type, Chinese Utility Model Application No. 200820235058.4 discloses a card edge connector 107 including an insulator body 101 having an insertion groove 100 formed therein; a front-row terminal having a soldering leg 102; a back-row terminal having a soldering leg 103, and a lock button device 106 having an inserting contact portion 104 and a soldered portion 105, as shown in FIG. 12 of this application. Inserting the inserting contact portion 104 of the lock button device 106 into the insertion groove 100 of the insulator body 101 allows the inserting contact portion 104 of the lock button device 106 to float within the insertion groove 100. To install the card edge connector 107 on a motherboard, the soldering leg 102 and the soldering leg 103 are first attached to the motherboard. Then, the automatic adjustment function of the lock button device 106 allows the soldered portion 105 of the lock button device 106 to obtain a satisfactory coplanarity between the soldering leg 102 and the soldering leg 103, thereby solving a problem of a horizontal error between the inserting contact portion 104 of the lock button device 106 and the insulator body 101.

In the above-mentioned configuration disclosed in Chinese Utility Model Application No. 200820235058.4, however, the lock button device 106 cannot smoothly swing in some cases.

It is an object of the present invention to provide a card edge connector that allows an arm member (corresponding to the lock button device 106) to smoothly swing.

SUMMARY OF THE INVENTION

According to an exemplary aspect of the present invention, a card edge connector used to be mounted on a connector mounting surface of a motherboard to connect a daughterboard to the motherboard has a configuration as described below. That is, the card edge connector includes: an elongated housing; a plurality of contacts held by the housing; an arm member for pressing, toward the connector mounting surface, the daughterboard to be displaced in a direction away from the connector mounting surface. The arm member includes an arm inserted portion. The housing includes an insertion groove in which the arm inserted portion of the arm member is inserted. The arm inserted portion of the arm member is inserted in the insertion groove of the housing to allow the housing to hold the arm member freely swingable about the arm inserted portion with respect to the housing. Gap amount securing means for securing at least a predetermined gap amount of a pair of swing gaps is provided in at least one of the pair of swing gaps, the pair of swing gaps being formed in a longitudinal direction of the housing between the arm member within the insertion groove and the housing.

Preferably, the gap amount securing means is a projection formed on one of the arm member and the housing.

Preferably, the arm member is made of metal; the housing is made of resin; and the projection is formed on the arm member.

Preferably, the arm inserted portion is formed by press working, and the projection is formed in one of the pair of swing gaps in which a burr of the arm inserted portion is present.

Preferably, a plurality of projections are formed in a direction orthogonal to the connector mounting surface.

Preferably, a plurality of projections are formed in the longitudinal direction of the arm member.

Preferably, the gap amount securing means is provided in both the pair of swing gaps.

Preferably, a principal surface of the insertion groove of the housing is orthogonal to the connector mounting surface of the motherboard.

Preferably, the arm inserted portion of the arm member includes a swing fulcrum portion serving as a swing center of the arm member with respect to the housing, and the housing includes an arm swing support portion that contacts the swing fulcrum portion of the arm inserted portion of the arm member.

Preferably, the swing fulcrum portion of the arm inserted portion of the arm member contacts a top surface of the arm swing support portion of the housing.

According to an exemplary aspect of the present invention, it it possible to secure at least a predetermined amount of at least one of the gap amounts of the pair of swing gaps, thereby enabling the arm member to smoothly swing.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

A card edge connector 1 according to an exemplary embodiment of the present invention will be described below with reference to FIGS. 1 to 11.

Figure 1:
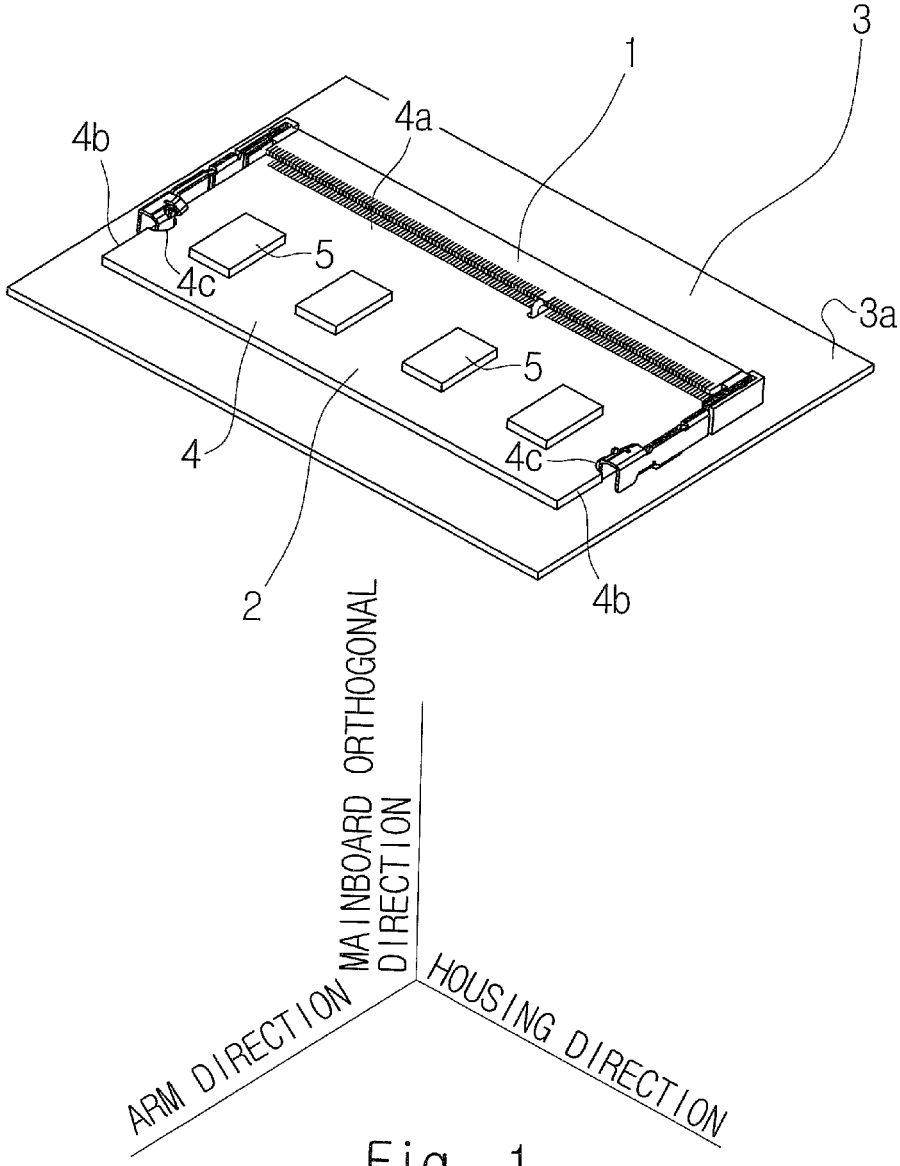
FIG. 1 is a perspective view showing a state where a memory module is mounted to a card edge connector.
Figure 2:
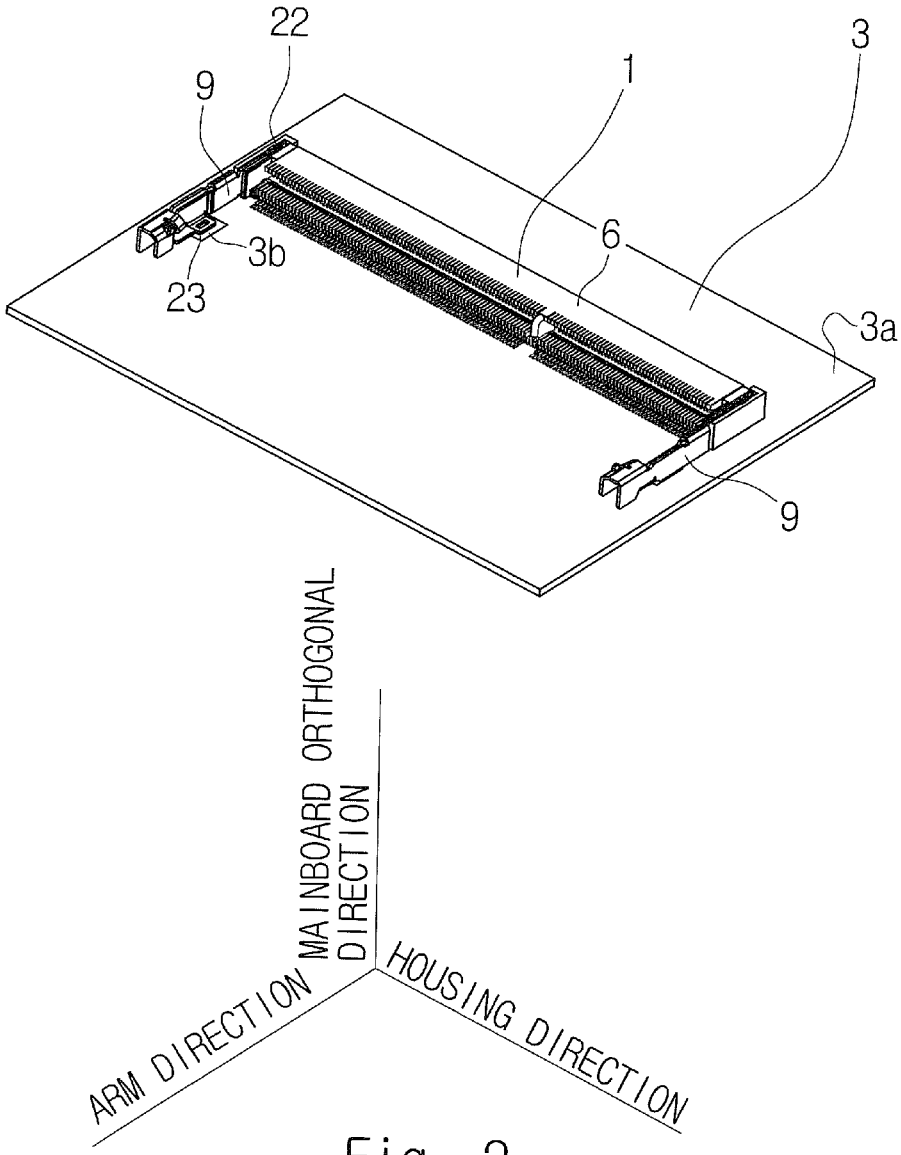
FIG. 2 is a perspective view showing a state where the memory module is dismounted from the card edge connector.

As shown in FIGS. 1 and 2, the card edge connector 1 is used to be mounted on a connector mounting surface 3*a* of a mainboard 3 to connect a memory module 2 (daughterboard) to the mainboard 3 (motherboard).

As shown in FIG. 1, the memory module 2 includes a PCB 4 (Printed Circuit Board) and a plurality of semiconductor packages 5 arranged on both sides (the back side is not shown) of the PCB 4. The PCB 4 includes a contact edge 4*a* and a pair of side edges 4*b*. Semicircular notches 4*c* are formed in the side edges 4*b* of the PCB 4.

(Card Edge Connector 1)

Figure 3:
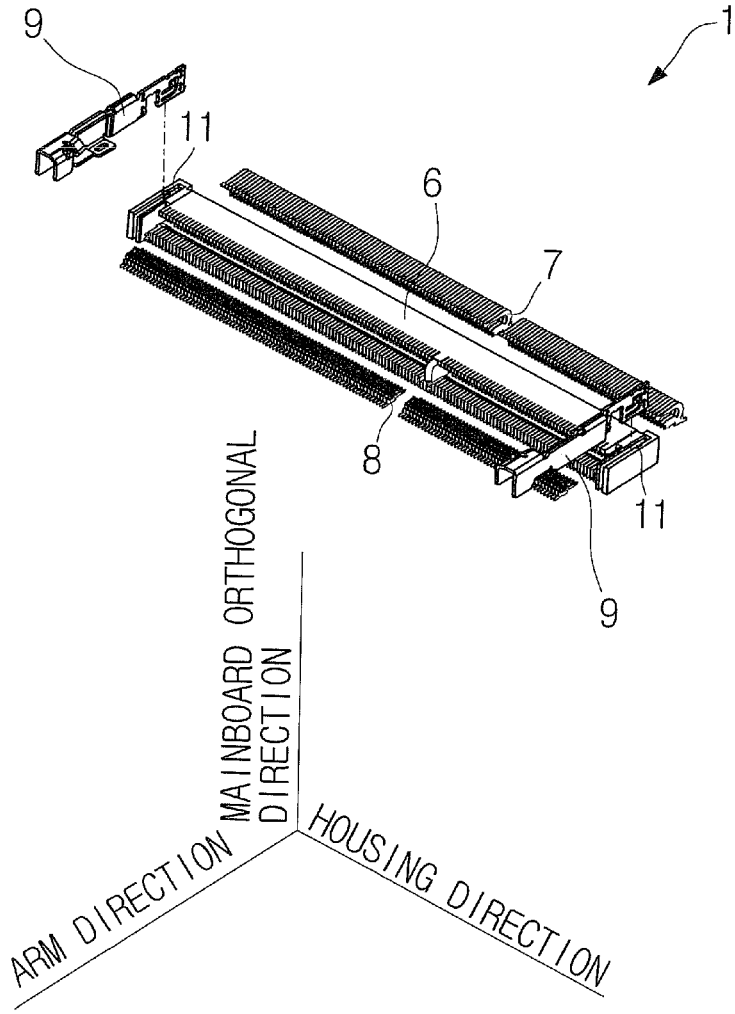
FIG. 3 is an exploded perspective view of the card edge connector.

As shown in FIG. 3, the card edge connector 1 includes an elongated housing 6, a plurality of upper stage contacts 7 (contacts), a plurality of lower stage contacts 8 (contacts), and a pair of arm members 9.

Referring now to FIGS. 2 and 3, the terms "housing direction", "arm direction", and "mainboard orthogonal direction" are defined. The "housing direction", "arm direction", and "mainboard orthogonal direction" are orthogonal to each other. The term "housing direction" refers to the longitudinal direction of the housing 6 as shown in FIG. 3. In the "housing direction", a direction toward the center in the longitudinal direction of the housing 6 is referred to as "housing center direction", and a direction away from the center in the longitudinal direction of the housing 6 is referred to as "housing anti-center direction". The term "arm direction" refers to a direction which is in parallel with the direction of the surface of the mainboard 3 and is orthogonal to the housing direction as shown in FIG. 2. In the "arm direction", a direction approaching the housing 6 is referred to as "arm proximal end direction", and a direction away from the housing 6 is referred to as "arm distal end direction". The term "mainboard orthogonal direction" refers to a direction orthogonal to the connector mounting surface 3*a* of the mainboard 3. In the "mainboard orthogonal direction", a direction approaching the mainboard 3 is referred to as "mainboard approaching direction", and a direction away from the mainboard 3 is referred to as a "mainboard separating direction".

(Housing 6)

Figure 5:
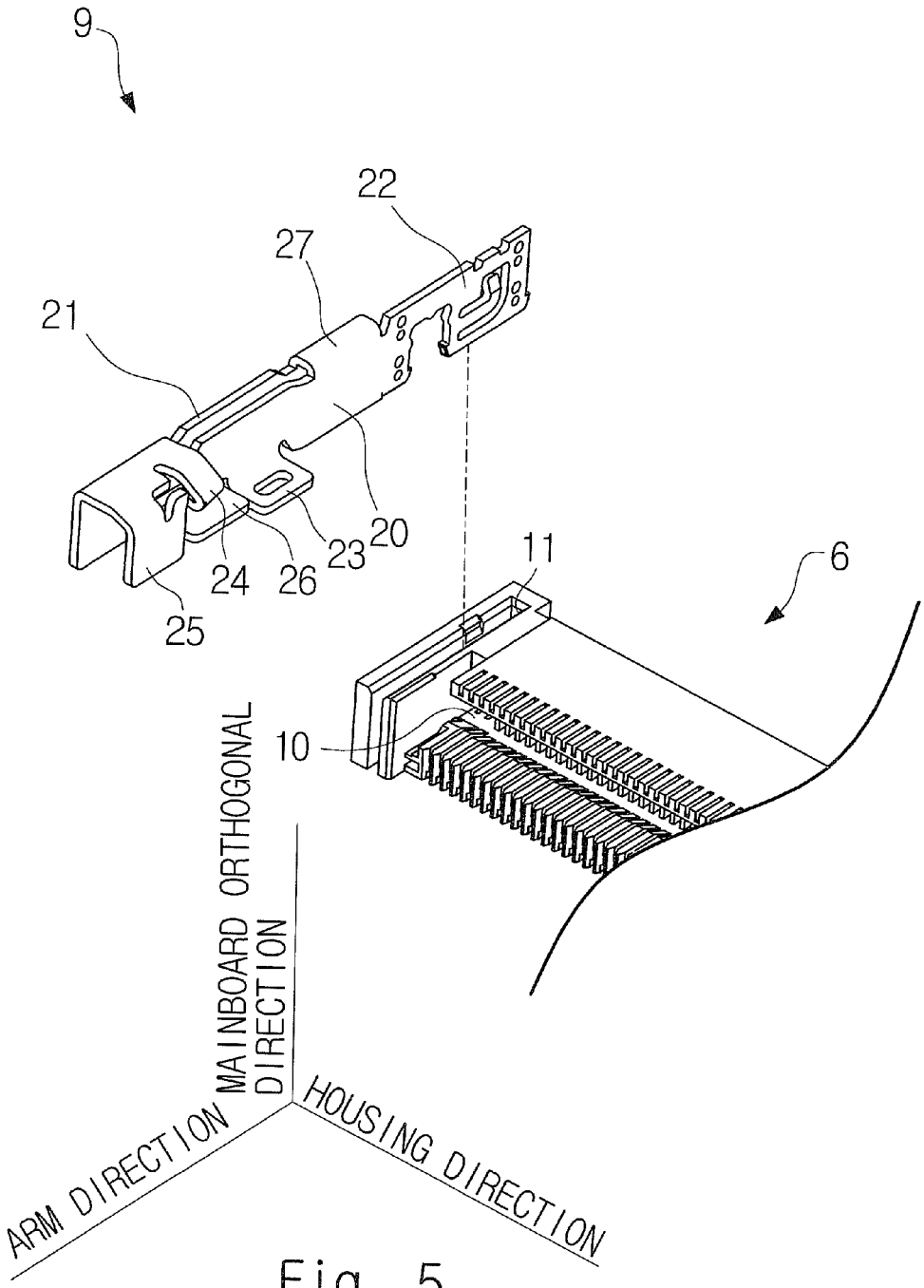
FIG. 5 is an enlarged view of a substantial part of FIG. 3.

The housing 6 is made of resin having insulating properties, and holds the plurality of upper stage contacts 7 and the plurality of lower stage contacts 8 as shown in FIG. 3. The housing 6 is formed in an elongated shape depending on the number of terminals formed on the memory module 2. The plurality of upper stage contacts 7 and the plurality of lower stage contacts 8, which are held by the housing 6, are soldered to the connector mounting surface 3*a* of the mainboard 3, thereby being fixed to the connector mounting surface 3*a* of the mainboard 3. As shown in FIG. 5, the housing 6 has an insertion opening 10 for inserting the contact edge 4*a* (see FIG. 1) of the memory module 2. When the contact edge 4*a* of the memory module 2 is inserted in the insertion opening 10 from an obliquely upward direction, the memory module 2 is held by the plurality of upper stage contacts 7 and the plurality of lower stage contacts 8 in the state of being inclined obliquely with respect to the connector mounting surface 3*a* of the mainboard 3. As shown in FIGS. 3 and 5, insertion grooves 11 for mounting the arm members 9 are formed at ends in the housing direction of the housing 6. The insertion grooves 11 are formed to be opened in the arm distal end direction and the mainboard separating direction.

(Upper Stage Contact 7)

Figure 4A:
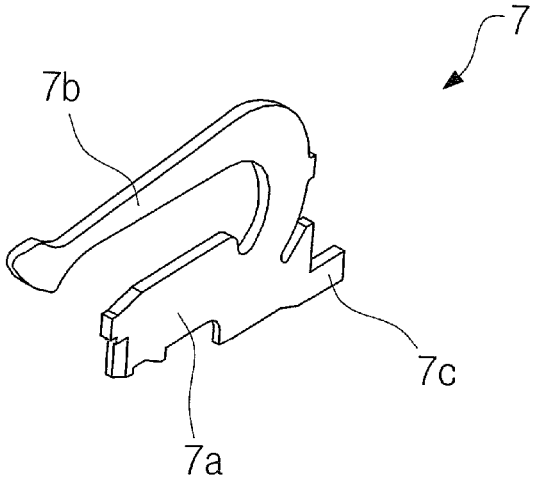
FIG. 4A is a perspective view of an upper stage contact.

As shown in FIG. 4A, each upper stage contact 7 includes a a held portion 7*a* which is held by the housing 6; a contact portion 7*b* which connects to the held portion 7*a* and contacts a signal terminal formed on the PCB 4 of the memory module 2; and a soldered portion 7*c* which connects to the held portion 7*a* and is soldered to the connector mounting surface 3*a* of the mainboard 3.

(Lower Stage Contact 8)

Figure 4B:
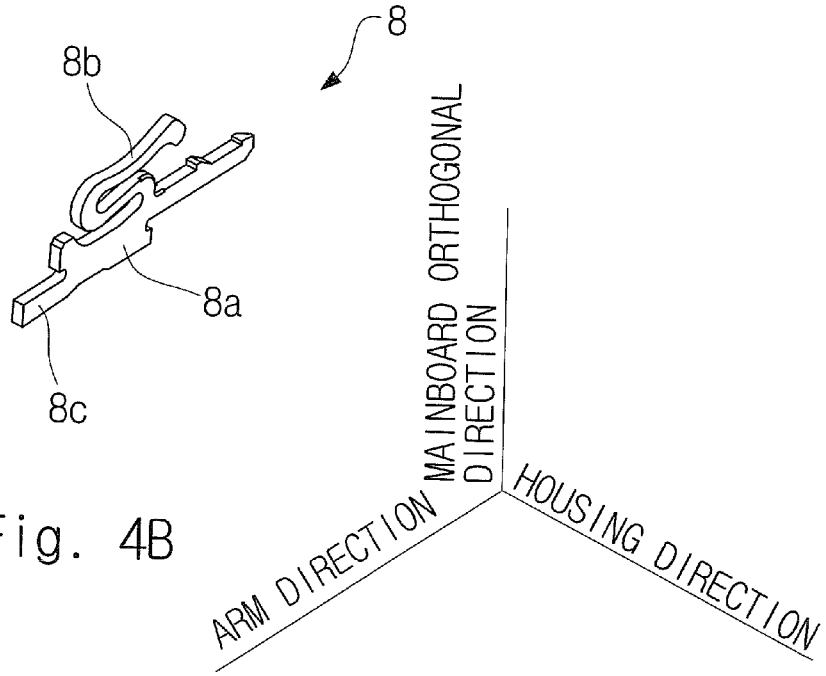
FIG. 4B is a perspective view of a lower stage contact.

As shown in FIG. 4B, each lower stage contact 8 includes a held portion 8*a* which is held by the housing 6; a contact portion 8*b* which connects to the held portion 8*a* and contacts a signal terminal formed on the PCB 4 of the memory module 2; and a soldered portion 8*c* which contacts to the held portion 8*a* and is soldered to the connector mounting surface 3*a* of the mainboard 3.

(Arm Member 9)

The pair of arm members 9 shown in FIG. 2 is configured to press, toward the connector mounting surface 3*a* of the mainboard 3, the memory module 2 which is to be displaced in the direction away from the connector mounting surface 3*a* of the mainboard 3 when the memory module 2 is pressed toward the mainboard 3 in the state where the contact edge 4*a* (see FIG. 1) of the memory module 2 is inserted in the insertion opening 10 (see FIG. 5) of the housing 6 and the memory module 2 is obliquely held. As shown in FIGS. 2 and 3, the pair of arm members 9 is mounted to the ends in the housing direction of the housing 6, and is formed in an elongated shape extending in the arm distal end direction. Each of the arm members 9 is formed by performing press work and folding work on a single metal sheet. As shown in FIG. 2, the pair of arm members 9 has a symmetrical shape with respect to the housing 6. Accordingly, the following description will be made assuming that the pair of arm members 9 has the same shape.

Figure 6:
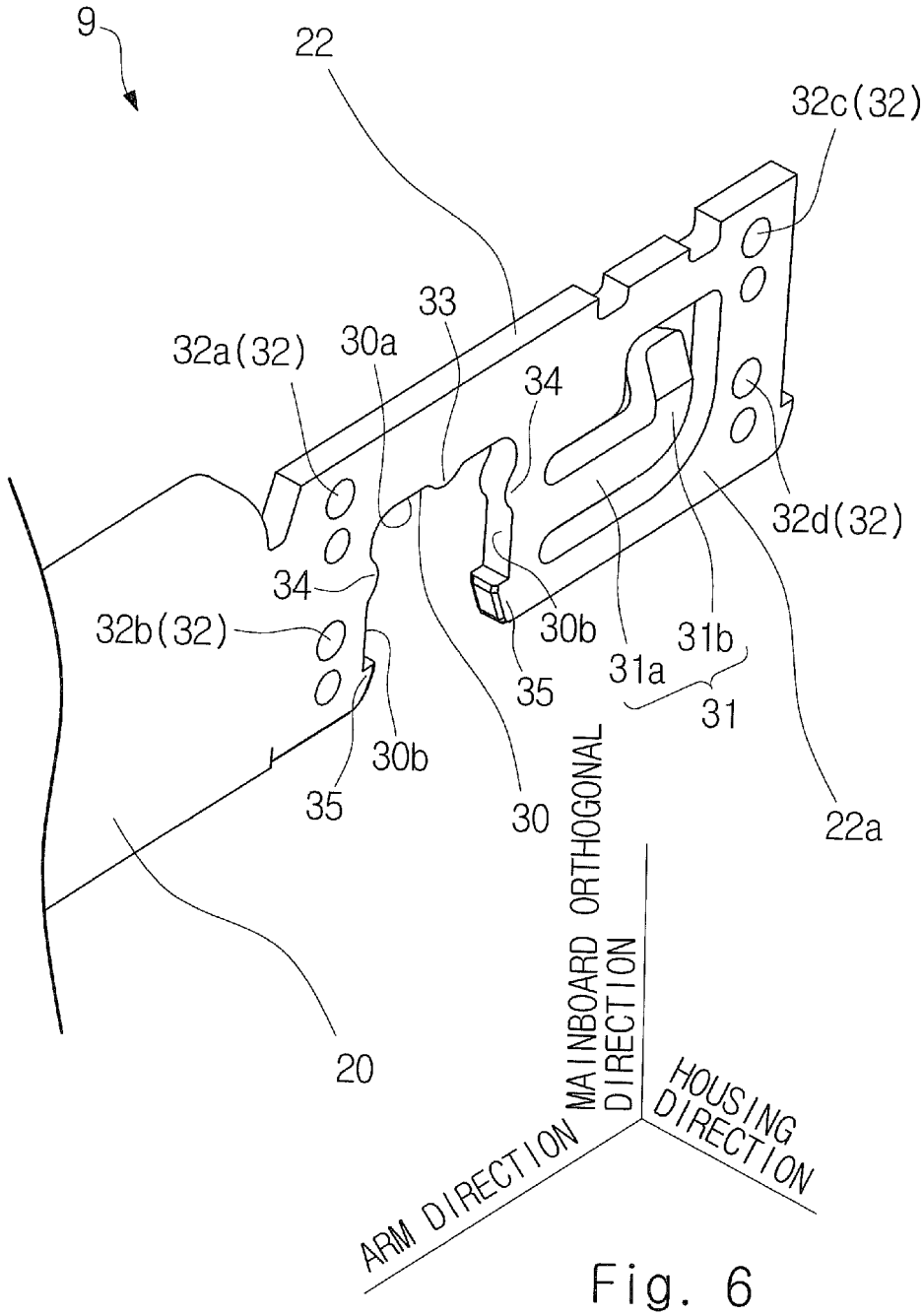
FIG. 6 is an enlarged view of a substantial part of FIG. 5.
Figure 7:
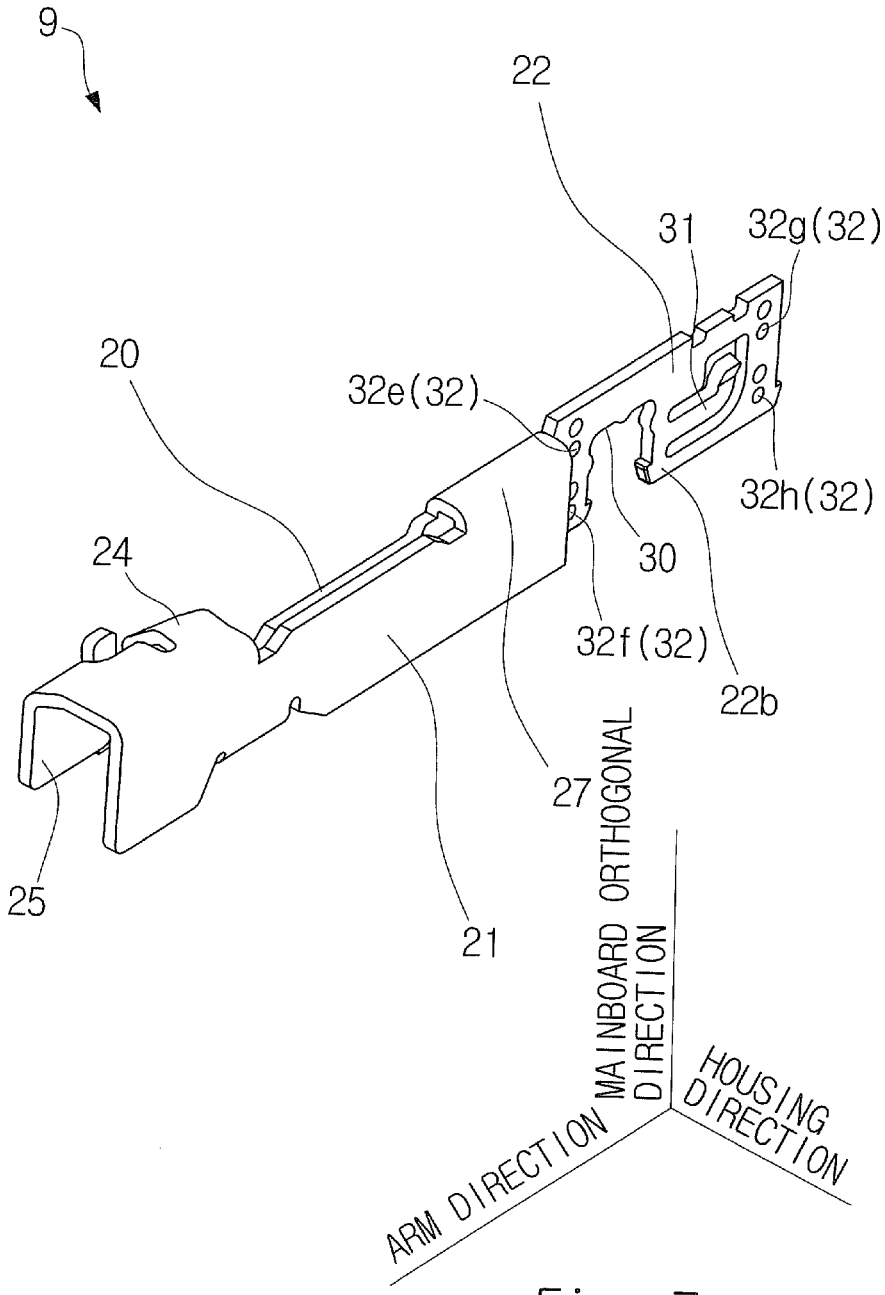
FIG. 7 is a perspective view of the other arm member opposed to one arm member shown in FIG. 6.

As shown in FIGS. 5 to 7, each arm member 9 mainly includes a fixing portion 20, a spring portion 21, and an arm inserted portion 22. The fixing portion 20 has an SMT (Surface Mount Tab) portion 23. The spring portion 21 has a latch portion 24, an interference portion 25, and a regulation portion 26. Each of the fixing portion 20, the spring portion 21, and the arm inserted portion 22 is in such a posture that the principal surface is orthogonal to the housing direction, and is formed in an elongated shape along the arm direction.

The fixing portion 20 shown in FIG. 5 is configured to fix an end in the arm proximal end direction of the spring portion 21 to the connector mounting surface 3*a* of the mainboard 3. When the SMT portion 23 of the fixing portion 20 is soldered to the connector mounting surface 3*a* of the mainboard 3, the end in the arm proximal end direction of the spring portion 21 is fixed to the connector mounting surface 3*a* of the mainboard 3 through the fixing portion 20.

The spring portion 21 shown in FIG. 5 is a plate spring for elastically supporting the latch portion 24 so that the latch portion 24 can be elastically displaced in the housing direction. The spring portion 21 is disposed on the side of the housing anti-center direction when viewed from the fixing portion 2. The spring portion 21 overlaps the fixing portion 20 in the housing direction and is in parallel with the fixing portion 20. The spring portion 21 is coupled to the fixing portion 20 through a folding portion 27. Specifically, the end in the arm proximal end direction of the spring portion 21 is coupled to the end in the arm proximal end direction of the fixing portion 20 through the folding portion 27. Each of the latch portion 24, the interference portion 25, and the regulation portion 26 is formed at the end in the arm distal end direction of the spring portion 21.

The latch portion 24 is configured to press, in the mainboard approaching direction, the memory module 2 which is to be displaced in the mainboard separating direction.

The interference portion 25 is configured to detect whether the contact edge 4*a* of the memory module 2 is appropriately inserted in the insertion opening 10 of the housing 6 (also see FIG. 1). When the contact edge 4*a* is not appropriately inserted in the insertion opening 10, the interference portion 25 physically interferes with the side edges 4*b* of the memory module 2, thereby inhibiting the memory module 2 from being pressed in the mainboard approaching direction. On the other hand, when the contact edge 4*a* is appropriately inserted in the insertion opening 10, the interference portion 25 is housed in the corresponding notch 4*c* formed in the corresponding side edge 4*b* of the memory module 2, thereby allowing the memory module 2 to be pressed in the mainboard approaching direction.

The regulation portion 26 is configured to regulate an excessive displacement in the housing anti-center direction of the interference portion 25.

The arm inserted portion 22 is disposed on the side of the arm proximal end direction when viewed from the fixing portion 20, and connects to the end on the side of the arm proximal end direction of the fixing portion 20. Each arm inserted portion 22 of the arm member 9 is inserted in the corresponding insertion groove 11 of the housing 6, thereby allowing the housing 6 to hold each arm member 9 such that each ram member 9 is freely swingable about each arm inserted portion 22 with respect to the housing 6. As shown in FIGS. 6 and 7, each arm inserted portion 22 includes a center-side side surface 22*a* which is a surface on the side of the housing center direction, and an anti-center-side side surface 22*b* which is a surface on the side of the housing anti-center direction.

Specifically, as shown in FIGS. 6 and 7, the arm inserted portion 22 has a swing notch 30, a retaining engagement claw portion 31, and eight hemispherical projections 32. The swing notch 30 is disposed on the side of the arm distal end direction of the arm inserted portion 22. The retaining engagement claw portion 31 is disposed on the side of the arm proximal end direction of the arm inserted portion 22.

(Hemispherical Projection 32)

As shown in FIG. 6, the center-side side surface 22*a* of the arm inserted portion 22 has four hemispherical projections 32. A first hemispherical projection 32*a* and a second hemispherical projection 32*b* are formed as two hemispherical projections 32 side by side along the mainboard orthogonal direction at the end on the side of the arm distal end direction of the center-side side surface 22*a* of the arm inserted portion 22. The first hemispherical projection 32*a* is disposed on the side of the mainboard separating direction with respect to the second hemispherical projection 32*b*. Similarly, a third hemispherical projection 32*c* and a fourth hemispherical projection 32*d* are formed as two hemispherical projections 32 side by side along the mainboard orthogonal direction at the end on the side of the arm proximal end direction of the center-side side surface 22*a* of the arm inserted portion 22. The third hemispherical projection 32*c* is disposed on the side of the mainboard separating direction with respect to the fourth hemispherical projection 32*d*. The first hemispherical projection 32*a* and the third hemispherical projection 32*c* are arranged side by side in the arm direction. The second hemispherical projection 32*b* and the fourth hemispherical projection 32*d* are also arranged side by side in the arm direction. Each of the first hemispherical projection 32*a*, the second hemispherical projection 32*b*, the third hemispherical projection 32*c*, and the fourth hemispherical projection 32*d* is formed to be raised in the housing center direction from the center-side side surface 22*a* of the arm inserted portion 22.

Similarly, as shown in FIG. 7, the anti-center-side side surface 22*b* of the arm inserted portion 22 has four hemispherical projections 32. A fifth hemispherical projection 32*e* and a sixth hemispherical projection 32*f* are formed as two hemispherical projections 32 side by side along the mainboard orthogonal direction at the end on the side of the arm distal end direction of the anti-center-side side surface 22*b* of the arm inserted portion 22. The fifth hemispherical projection 32*e* is disposed on the side of the mainboard separating direction with respect to the sixth hemispherical projection 32*f*. Similarly, a seventh hemispherical projection 32*g* and an eighth hemispherical projection 32*h* are formed as two hemispherical projections 32 side by side along the mainboard orthogonal direction at the end on the side of the arm proximal end direction of the anti-center-side side surface 22*b* of the arm inserted portion 22. The seventh hemispherical projection 32*g* is disposed on the side of the mainboard separating direction with respect to the eighth hemispherical projection 32*h*. The fifth hemispherical projection 32*e* and the seventh hemispherical projection 32*g* are arranged side by side in the arm direction. The sixth hemispherical projection 32*f* and the eighth hemispherical projection 32*h* are also arranged side by side in the arm direction. Each of the fifth hemispherical projection 32*e*, the sixth hemispherical projection 32*f*, the seventh hemispherical projection 32*g*, and the eighth hemispherical projection 32*h* is formed to be raised in the housing anti-center direction from the anti-center-side side surface 22*b* of the arm inserted portion 22.

Figure 8:
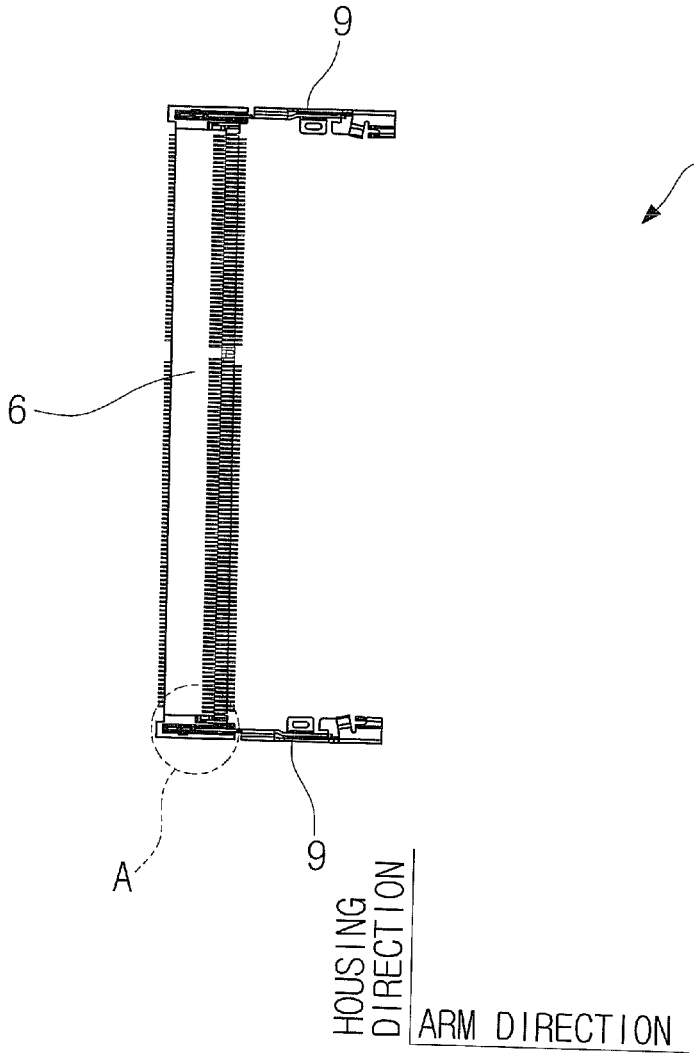
FIG. 8 is a plan view of the card edge connector.
Figure 9:
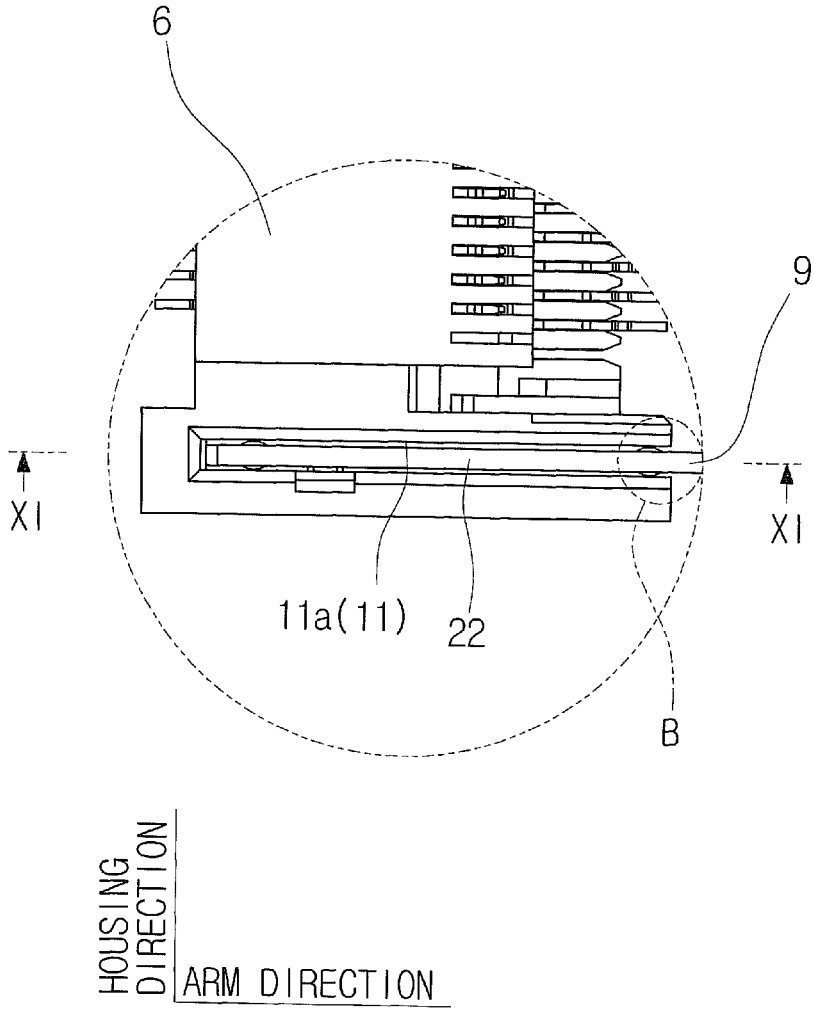
FIG. 9 is an enlarged view of a portion "A" shown in FIG. 8.
Figure 10:
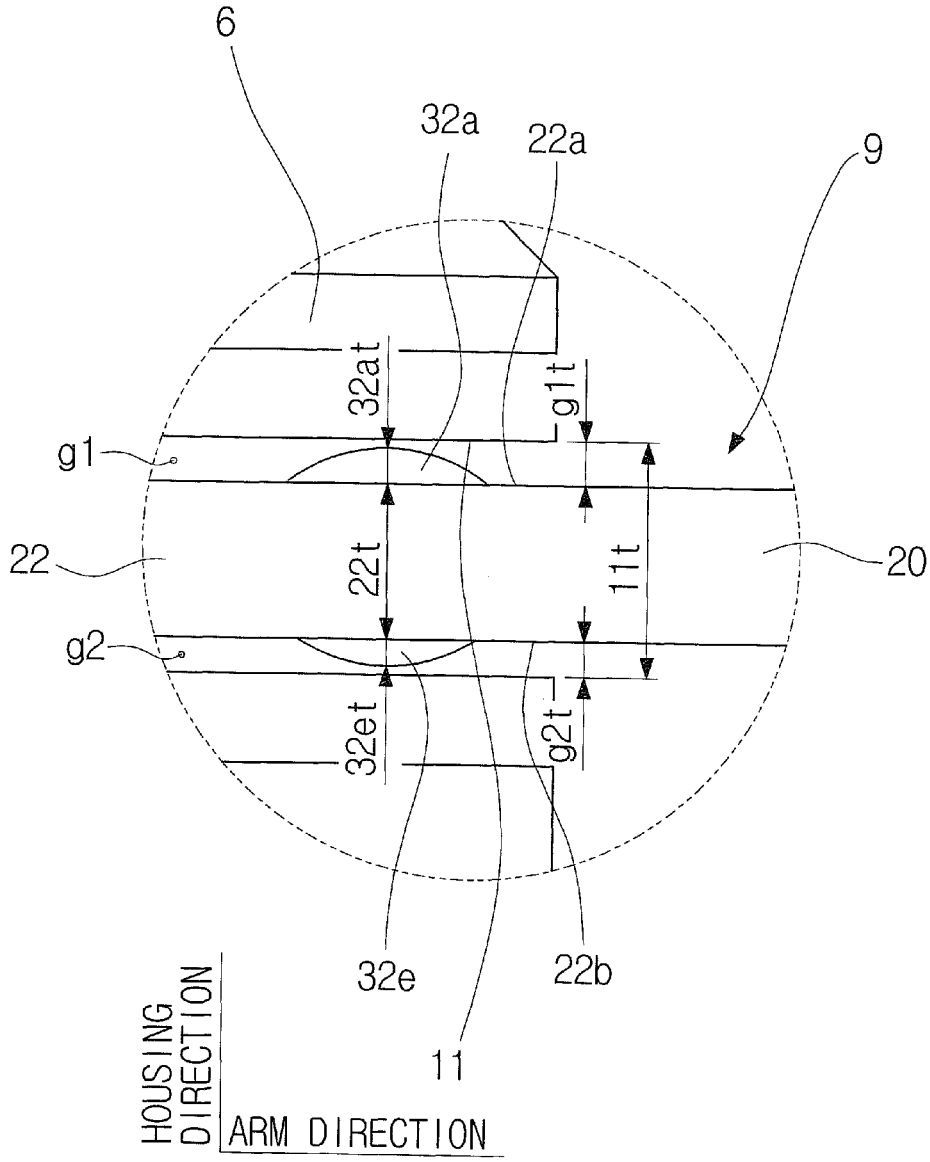
FIG. 10 is an enlarged view of a portion "B" shown in FIG. 9.

FIG. 9 is an enlarged view of a portion "A" shown in FIG. 8. FIG. 10 is an enlarged view of a portion "B" shown in FIG. 9. As shown in FIG. 10, a thickness 22*t* in the housing direction of the arm inserted portion 22 of each arm member 9 is relatively smaller than a groove width 11*t* in the housing direction of each insertion groove 11 of the housing 6. Accordingly, when the arm inserted portion 22 is inserted in the corresponding insertion groove 11, a swing gap g1 and a swing gap g2 are formed in each insertion groove 11 between the corresponding arm member 9 and the housing 6. Further, as described above, the first hemispherical projection 32*a* is formed on the center-side side surface 22*a* of the arm inserted portion 22 of the arm member 9. Therefore, the relation $g1t \geq 32at$ is established between the gap amount g1*t* of the swing gap g1 and the thickness 32*at* in the housing direction of the first hemispherical projection 32*a*. Similarly, the fifth hemispherical projection 32*e* is formed on the anti-center-side side surface 22*b* of the arm inserted portion 22 of the corresponding arm member 9. Therefore, the relation $g2t \geq 32et$ is established between the gap amount g2*t* of the swing gap g2 and the thickness 32*et* in the housing direction of the fifth hemispherical projection 32*e*. Note that the above-mentioned relations also hold for the other hemispherical projections 32. The provision of the swing gap g1 and the swing gap g2 enables smooth swinging of each arm member 9 and effectively suppresses motions of each arm member 9 in the direction of arm direction axial rotation and the direction of mainboard orthogonal direction axial rotation.

(Swing Notch 30)

Figure 11:
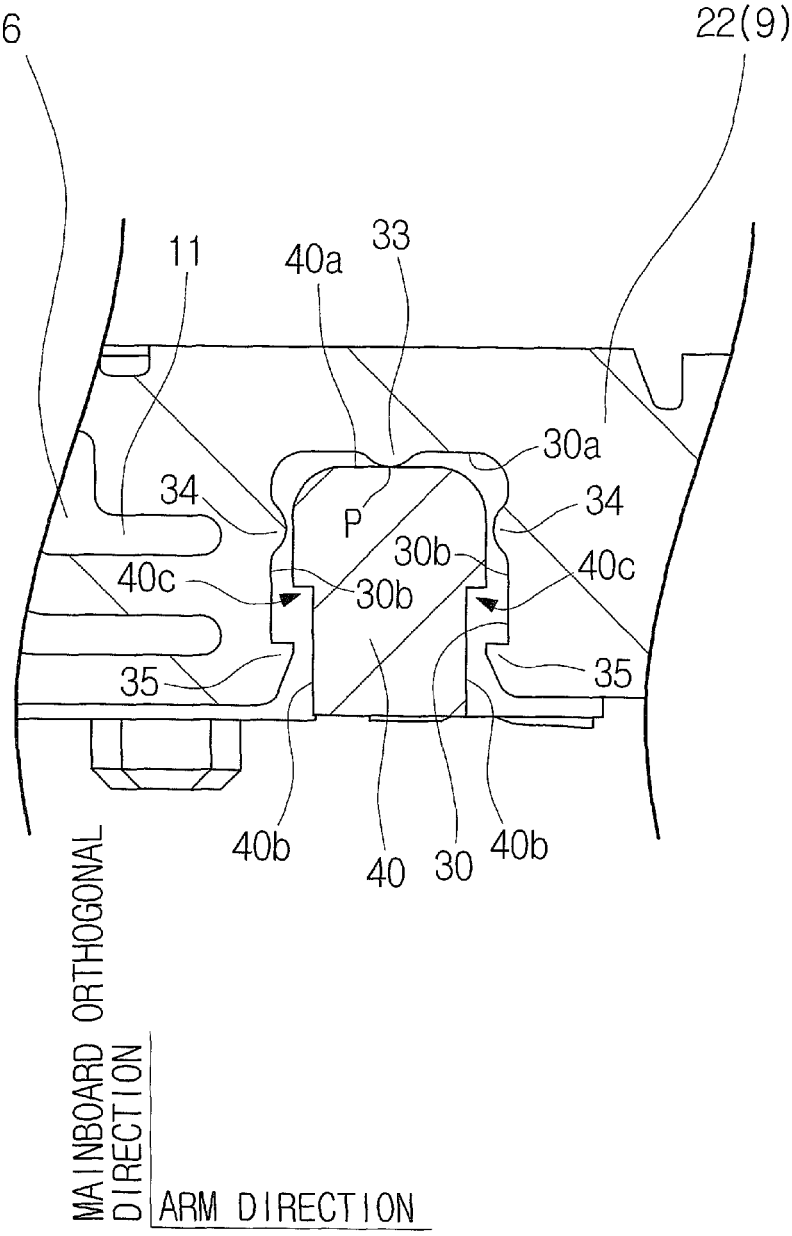
FIG. 11 is a partial sectional view taken along the line XI-XI of FIG. 9.
Figure 12:
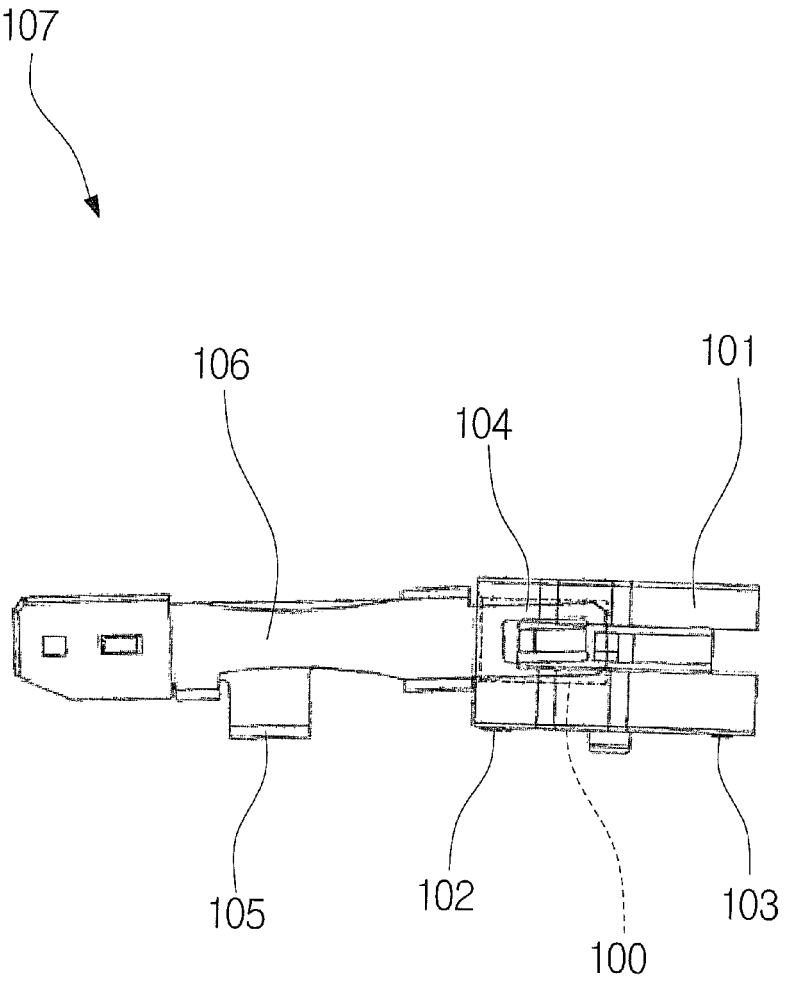
Fig. 12 Related Art
FIG. 12 is a diagram corresponding to FIG. 5 of Chinese Utility Model Application No. 200820235058.4.

As shown in FIG. 11, the swing notch 30 is a notch opened in the mainboard approaching direction. The swing notch 30 has a ceiling surface 30*a* opposed to the connector mounting surface 3*a* of the mainboard 3, and a pair of inner surfaces 30*b* orthogonal to the arm direction. The ceiling surface 30*a* has a swing fulcrum portion 33 projecting in the mainboard approaching direction. Each inner surface 30*b* has a swing regulation portion 34 projecting inward of the swing notch 30. A retaining projection 35 projecting to the inside of the swing notch 30 is formed at an end on the side of the mainboard approaching direction of each inner surface 30*b*. On the other hand, an arm swing support portion 40 housed in the swing notch 30 is formed in the corresponding insertion groove 11 of the housing 6. The arm swing support portion 40 has a top surface 40*a* opposed to the ceiling surface 30*a* of the swing notch 30, and a pair of side surfaces 40*b* opposed to the respective inner surfaces 30*b* of the swing notch 30. Further, a step portion 40*c* is formed on each side surface 40*b*. In the configuration described above, when the arm inserted portion 22 of the arm member 9 is inserted in the corresponding insertion groove 11 of the housing 6, the swing fulcrum portion 33 of the swing notch 30 of the arm inserted portion 22 contacts the top surface 40*a* of the arm swing support portion 40 of the housing 6. A contact point P between the swing fulcrum portion 33 and the top surface 40*a* serves as a fulcrum of swinging of the corresponding arm member 9 with respect to the housing 6. In other words, the swing fulcrum portion 33 of the arm inserted portion 22 of each arm member 9 functions as the swing center of the arm member 9 with respect to the housing 6. The permissible amount of swinging of each arm member 9 with respect to the housing 6 is regulated by a contact between the swing regulation portion 34 of the swing notch 35 of the arm inserted portion 22 and each side surface 40*b* of the arm swing support portion 40. Additionally, when the arm inserted portion 22 of the arm member 9 is dismounted from the corresponding insertion groove 11, the retaining projections 35 of the swing notch 30 are caught on the respective step portions 40*c* of the arm swing support portion 40, thereby suppressing the arm inserted portion 22 of each arm member 9 from being easily disengaged from the corresponding insertion groove 11.

(Retaining Engagement Claw Portion 31)

As shown in FIG. 6, the retaining engagement claw portion 31 includes a spring portion 31*a* and a claw portion 31*b*. The spring portion 31*a* is configured to allow the claw portion 31*b* to be elastically displaced in the housing direction. The claw portion 31*b* engages with an engaged portion (not shown) formed within the corresponding insertion groove 11, thereby suppressing the arm inserted portion 22 of the corresponding arm member 9 from being easily disengaged.

(Usage of Card Edge Connector 1)

Next, an exemplary usage of the card edge connector 1 will be described. First, the plurality of upper stage contacts 7 and the plurality of lower stage contacts 8 are mounted on the housing 6 from the state shown in FIG. 3. Next, each arm inserted portion 22 of the arm member 9 shown in FIG. 5 is inserted in the corresponding insertion groove 11 of the housing 6 in the mainboard approaching direction. Then, the claw portion 31*b* of the retaining engagement claw portion 31 shown in FIG. 6 engages with the engaged portion of the corresponding insertion groove 11, and the swing fulcrum portion 33 of the swing notch 30 of the arm inserted portion 22 shown in FIG. 11 is seated on the top surface 40*a* of the arm swing support portion 40.

Referring next to FIG. 2, the card edge connector 1 is disposed on the connector mounting surface 3*a* of the mainboard 3. The soldered portion 7*c* of each upper stage contact 7 shown in FIG. 4A and the soldered portion 8*c* of each lower stage contact 8 shown in FIG. 4B are soldered to an electrode pad preliminarily formed on the connector mounting surface 3*a* of the mainboard 3.

In this state, each arm members 9 shown in FIG. 2 is swingable about the corresponding arm inserted portion 22 with respect to the housing 6. Accordingly, the SMT portion 23 of each arm member 9 is in contact with an arm fixing pad 3*b*, which is preliminarily formed on the connector mounting surface 3*a* of the mainboard 3, due to the effect of the self-weight of each arm member 9. Accordingly, the SMT portion 23 of each arm member 9 is soldered to the arm fixing pad 3*b* on the connector mounting surface 3*a* of the mainboard 3. This allows each arm member 9 to be switched from a swingable state to a non-swingable state and to be firmly fixed onto the connector mounting surface 3*a* of the mainboard 3.

While the first exemplary embodiment of the present invention has been described above, the features of the first exemplary embodiment are summarized as follows.

The card edge connector 1 is used to be mounted on the connector mounting surface 3*a* of the mainboard 3 to connect the memory module 2 (daughterboard) to the mainboard 3 (motherboard). The card edge connector 1 includes the elongated housing 6; the plurality of contacts (the upper stage contacts 7 and the lower stage contacts 8) held by the housing 6; and the arm members 9 for pressing, toward the connector mounting surface 3*a*, the memory module 2 to be displaced in the direction away from the connector mounting surface 3*a*. Each of the arm members 9 includes the arm inserted portion 22. The housing 6 includes the insertion grooves 11 in which the arm inserted portions 22 of the arm members 9 are respectively inserted. The arm inserted portions 22 of the arm members 9 are respectively inserted in the insertion grooves 11 of the housing 6, thereby allowing the housing 6 to hold the arm members 9 so that each arm member 9 is swingable about the corresponding arm inserted portion 22 with respect to the housing 6. Gap amount securing means (hemispherical projections 32) for securing at least a predetermined amount of each of the gap amounts g1*t* and g2*t* of the swing gaps g1 and g2 are provided in the pair of swing gaps g1 and g2, which are gaps formed in the longitudinal direction of the housing 6, between the arm members 9 within the insertion grooves 11 and the housing 6. According to the configuration described above, at least a predetermined amount of each of the gap amounts g1*t* and g2*t* of the swing gaps g1 and g2 is secured, thereby enabling smooth swinging of the arm members 9 with respect to the housing 6.

To put it the other way around, if the swing gap g1 or the swing gap g2 disappears, a burr of each arm member 9 contacts the inner wall surface (for example, see a principle surface 11*a* shown in FIG. 9) of the corresponding insertion groove 11 of the housing 6, for example, which inhibits smooth swinging of each arm member 9 with respect to the housing 6.

No that in the exemplary embodiment described above, the gap amount securing means are provided in both the swing gaps g1 and g2. Alternatively, the gap amount securing means may be provided in at least one of the swing gaps g1 and g2.

The gap amount securing means serve as the hemispherical projections 32 formed on each arm member 9. According to the configuration described above, the gap amount securing means can be achieved with a simple configuration.

Note that instead of forming the hemispherical projections 32 on each arm member 9, the hemispherical projections 32 may be formed on the housing 6. In other words, instead of forming the hemispherical projections 32 on the arm members 9, the hemispherical projections 32 may be formed on the inner wall surface (the principal surface 11*a* shown in FIG. 9) of each insertion groove 11 of the housing 6.

Each arm member 9 is made of metal and the housing 6 is made of resin. The hemispherical projections 32 are formed on each arm member 9. According to the configuration described above, the hemispherical projections 32 are hardly damaged when the arm inserted portion 22 of each arm member 9 is inserted in the corresponding insertion groove 1 of the housing 6, as compared to the case where the hemispherical projections 32 are formed on the housing made of resin.

Each arm inserted portion 22 is formed by press working. In this case, the hemispherical projections 32 are preferably formed in at least one of the swing gaps g1 and g2 in which the burr of the arm inserted portion 22 is present. The configuration described above solves the problem in that the burr of the arm inserted portion 22 is caught on the housing 6 to thereby inhibit swinging of each arm member 9 with respect to the housing 6.

As shown in FIGS. 6 and 7, the plurality of hemispherical projections 32 are formed side by side in the mainboard orthogonal direction. The configuration described above suppresses swinging of each arm member 9 with the longitudinal direction of each arm member 9 as a rotation axis.

As shown in FIGS. 6 and 7, the plurality of hemispherical projections 32 are formed side by side in the arm direction. The configuration described above suppresses swinging of each arm member 9 with the mainboard orthogonal direction as a rotation axis.

The gap amount securing means are provided in the pair of the swing gaps g1 and g2. According to the configuration described above, at least a predetermined amount of each of the gap amounts g1*t* and g2*t* of the pair of swing gaps g1 and g2 is secured, thereby enabling smoother swinging of each arm member 9 with respect to the housing 6.

As shown in FIG. 9, the principal surface 11*a* of each insertion groove 11 of the housing 6 is orthogonal to the connector mounting surface 3*a* (also see FIGS. 2 and 3) of the mainboard 3.

As shown in FIG. 11, the arm inserted portion 22 of each arm member 9 includes the swing fulcrum portion 33 serving as the swing center of each arm member 9 with respect to the housing 6. The housing 6 includes the arm swing support portion 40 that contacts the swing fulcrum portion 33 of the arm inserted portion 22 of each arm member 9. Further, the swing fulcrum portion 33 of the arm inserted portion 22 of each arm member 9 contacts the top surface 40*a* of the arm swing support portion 40 of the housing 6. The configuration described above enables stable holding with a fixed leg (SMT portion 23) as a fulcrum, against the repulsive force of the memory module 2.

As shown in FIG. 5, each insertion groove 11 of the housing 6 is opened in the mainboard separating direction, thereby allowing the direction in which the arm members 9 are inserted in the housing 6 to coincide with the mainboard approaching direction. Assuming that the direction in which the arm members 9 are inserted in the housing 6 coincides with the mainboard approaching direction, the arm inserted portion 22 of each arm member 9 can be directly clamped to thereby allow the arm inserted portion 22 to approach the corresponding insertion groove 11. In this case, as compared to the case where the arm inserted portion 22 of each arm member 9 is inserted in the corresponding insertion groove 11 in the arm proximal end direction by clamping the end in the arm distal end direction of each arm member 9, the arm inserted portion 22 of each arm member 9 can be smoothly inserted in the corresponding insertion groove 11. Furthermore, occurrence of buckling and damage of the arm members 9 during the insertion can be suppressed.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A card edge connector used to be mounted on a connector mounting surface of a motherboard to connect a daughterboard to the motherboard, the card edge connector comprising:

an elongated housing;

a plurality of contacts held by the housing;

an arm member for pressing, toward the connector mounting surface, the daughterboard to be displaced in a direction away from the connector mounting surface, wherein the arm member includes an arm inserted portion, the housing includes an insertion groove in which the arm inserted portion of the arm member is inserted, the arm inserted portion of the arm member is inserted in the insertion groove of the housing to allow the housing to hold the arm member freely swingable about the arm inserted portion with respect to the housing, and gap amount securing means for securing at least a predetermined gap amount of a pair of swing gaps is provided in at least one of the pair of swing gaps, the pair of swing gaps being formed in a longitudinal direction of the housing between the arm member within the insertion groove and the housing.

2. The card edge connector according to claim 1, wherein the gap amount securing means is a projection formed on one of the arm member and the housing.

3. The card edge connector according to claim 2, wherein the arm member is made of metal, the housing is made of resin, and the projection is formed on the arm member.

4. The card edge connector according to claim 3, wherein the arm inserted portion is formed by press working, and the projection is formed in one of the pair of swing gaps in which a burr of the arm inserted portion is present.

5. The card edge connector according to claim 2, wherein a plurality of projections are formed side by side in a direction orthogonal to the connector mounting surface.

6. The card edge connector according to claim 2, wherein a plurality of projections are formed in the longitudinal direction of the arm member.

7. The card edge connector according to claim 1, wherein the gap amount securing means is provided in both the pair of swing gaps.

8. The card edge connector according to claim 1, wherein a principal surface of the insertion groove of the housing is orthogonal to the connector mounting surface of the motherboard.

9. The card edge connector according to claim 1, wherein the arm inserted portion of the arm member includes a swing fulcrum portion which is a swing center of the arm member with respect to the housing, and the housing includes an arm swing support portion that contacts the swing fulcrum portion of the arm inserted portion of the arm member.

10. The card edge connector according to claim 9, wherein the swing fulcrum portion of the arm inserted portion of the arm member contacts a top surface of the arm swing support portion of the housing.

* * * * *